US005822395A

United States Patent [19]

Schardt et al.

[11] Patent Number: 5,822,395

[45] Date of Patent: Oct. 13, 1998

[54] X-RAY APPARATUS HAVING AN X-RAY TUBE WITH VARIO-FOCUS

[75] Inventors: Peter Schardt, Roettenbach; Erich Hell, Erlangen, both of Germany

[73] Assignee: Siemens Aktiengesellschaft, Munich, Germany

[21] Appl. No.: 940,269

[22] Filed: Sep. 29, 1997

[30] Foreign Application Priority Data

Sep. 27, 1996 [DE] Germany ..... 196 39 918.1

[51] Int. Cl.[6] ..... H05G 1/60

[52] U.S. Cl. ..... 378/137; 378/138; 378/119; 378/121

[58] Field of Search ..... 378/137, 138, 378/119, 121

[56] References Cited

U.S. PATENT DOCUMENTS 5,197,088 3/1993 Vincent et al. ..... 378/137

FOREIGN PATENT DOCUMENTS 0 127 983 12/1984 European Pat. Off. .

OS 2 252 911 5/1974 Germany .

87 13 042.4 3/1989 Germany .

*Primary Examiner*—Don Wong

*Attorney, Agent, or Firm*—Hill & Simpson

[57] ABSTRACT

An x-ray tube with vario-focus has an evacuated housing in which are arranged, rigidly connected thereto, an electron-emitting cathode and an anode dish which is struck by the electron beam, accelerated with an electrical field. An electromagnetic system for deflecting and focusing the electron beam is provided, and has a number of current-permeated coil elements. A lateral x-ray beam exit window is provided in the housing for the x-rays, which emerge at substantially a right angle relative to the longitudinal middle axis. The x-rays are picked up by an image receiver following a subject table. At least the anode dish is tiltable relative to the connecting axis to the image receiver, and the electromagnetic system at least partially surrounds a cathode-side neck section of the housing, and generates a quadrupole field for modifying the electron beam cross-section, corresponding to the tilt angle.

14 Claims, 4 Drawing Sheets

FOCUSSING VOLTAGE SOURCE
SUPPLY UNIT
TO 20
FROM 20
1
2
4
5
15
17
19
26
29
30
31
32
33
34
35
36
37
38
39
40
41
42

X-RAY APPARATUS HAVING AN X-RAY TUBE WITH VARIO-FOCUS

BACKGROUND OF THE INVENTION

1. Field of the Invention

The present invention is directed to an x-ray apparatus having an x-ray tube with vario-focus of the type having an evacuated housing in which a cathode is rigidly mounted and an anode dish which is struck at a focal spot by an electron beam emanating from the cathode, and having a system for focusing of the electron beam and an x-ray exit window provided in the housing, and an image receiver for the x-rays emerging through the x-ray exit window.

2. Description of the Prior Art

High-performance x-ray tubes are currently almost exclusively constructed as rotating anode tubes. Such x-ray tubes have a focal spot of a predetermined size and loadability when only one emitter is employed. In order to have focal spots of different size and loadability available, two or even three different emitters are often utilized, but the manufacture of appropriate focus heads is extremely complicated. Moreover, a fixed angle is selected for these x-ray tubes dependent on the application in order to assure the best possible compromise between anode loadability and the area to be irradiated. For CT tubes, for example, a small dish angle of approximately 8° is selected since only a flat fan beam is required. For diagnostic tubes, however, dish angles up to 16° are employed when larger image formats must be irradiated.

A basic problem is that a new tube type must be developed and manufactured for nearly every new application since the two important parameters, namely the size (i.e. area content) and geometry (i.e. contour) of the focal spot and the dish angle are fixed for every tube type. As a result of the large number of types, the item numbers for every x-ray tube type are low, so that the outlay for the development as well as for the manufacturing costs is extremely high.

SUMMARY OF THE INVENTION

An object of the present invention is to provide an x-ray apparatus of the type initially described wherein the required image format can be irradiated and the tube can be used with a focal spot having a suitable size and geometry for different applications.

This object is achieved in an x-ray tube constructed in accordance with the invention wherein at least the anode dish of the x-ray tube is tiltable with respect to the connecting axis between the focal spot and the center of the image receiver; and having a focusing system that generates a first field for varying the cross-sectional shape of the electron beam in conformity with the tilt angle.

Given a change of image format, i.e. a modified size of the exposure area of the image receiver, the dish angle, i.e. the angle between the obliquely placed dish edge and the connecting axis between the focal spot and the center of the image receiver, can be appropriately set as a result of the inventive design and structure. This allows for a variation of the cross-section of the electron beam, and thus a variation of the focal spot to occur together with variation of the dish angle, resulting in the optical image of the focal spot as seen from the image receiver in the direction of the connecting axis always maintaining the same size and geometry. An optimum image irradiation and image quality are always possible in this way.

For achieving an optimally good image quality, the first field can change the cross-sectional shape of the electron beam such that the focal spot—independently of the tilt angle—has a substantially quadratic or at least generally circular contour as seen in the direction of the connecting axis.

In order to be able to also modify the size of the cross-sectional area of the electron beam, and thus the area encompassed by the focal spot, the first field influences only the cross-sectional geometry of the electron beam, and thus the contour of the focal spot. The system for focusing the electron beam can generate a second field that changes the cross-sectional area of the electron beam, and thus the area of the focal spot.

In order to assure a constant resolution independently of the selected tilt, the system for focusing the electron beam generates the first and the second field such that, independently of the set tilt angle, the area of the image of the focal spot projected onto the image receiver by parallel projection in the direction of the connecting axis and the contour of the focal spot as seen in the direction of the connecting axis, remain the same. In this context that the area of the image of the focal spot projected onto the image receiver by parallel projection in the direction of the connecting axis can be set to a desired value by varying the second field, this being retained regardless of the tilt angle that is set.

In one embodiment of the invention, the first field is a quadrupole field.

If the x-ray tube is a rotating anode tube having a rotating anode driven in the stationary housing, an embodiment of the invention the rotational axis of the rotating anode is offset parallel relative to the electron beam axis by the average radius of the anode dish edge, so that the electron beam strikes the anode dish edge without lateral deflection, and the first field serving for modification of the contour of the focal spot is a dipole-free quadrupole field. In this case, the variation of the dish angle can ensue either by tilting only the anode dish within the stationary x-ray tube, i.e., the stationary housing of the x-ray tube, is tilted, or by tilting the entire tube.

If the x-ray tube is a rotating bulb tube with a housing rotatable around a rotational axis with a drive mechanism, the anode being also rigidly connected thereto, the tilt for varying the dish angle ensues only by tilting the housing together with the rotational bearings. In this case, the first field is a quadrupole field on which a dipole field is superimposed for the deflection of the electron beam.

In a design wherein a deflection of electron beam is needed in addition to the deformation in order to form the focal spot on the obliquely disposed edge of the anode dish, it is advantageous to operate the coil element with at least two separate current sources in order to be able to separately influence the quadrupole field and the dipole field.

Preferably, the electromagnetic system is composed of coil elements arranged in a common carrier at least partially surrounding the housing. In one embodiment of the invention, pole projections directed to the housing can be fashioned at the carrier, the coil elements being arranged at that location. The carrier is preferably an iron yoke, and can be fashioned of one piece or of a number of parts. The parts can be detachably secured to one another. The yolk can be dimensioned in terms of its diameter so that the carrier can be attached in self-holding fashion to the housing. Alternatively, the pole projections can be correspondingly dimensioned in terms of their diameter.

DESCRIPTION OF THE PREFERRED EMBODIMENTS

Figure 1:
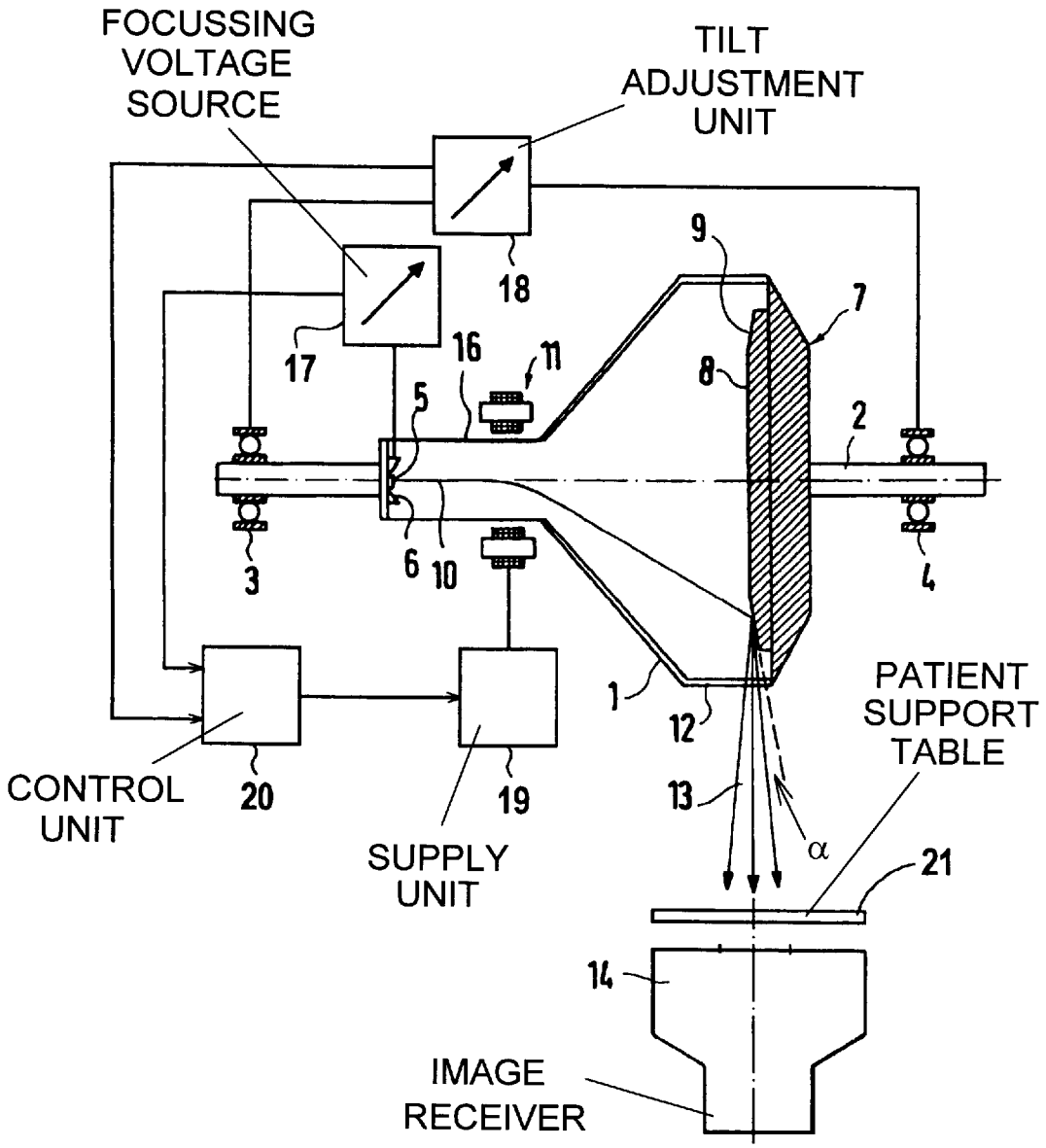
FIG. 1 is a schematic illustration of an inventive x-ray apparatus with an electromagnetic system for influencing the electron beam, with the x-ray tube, fashioned as a rotating bulb tube, and the image receiver being only schematically shown.
Figure 2:
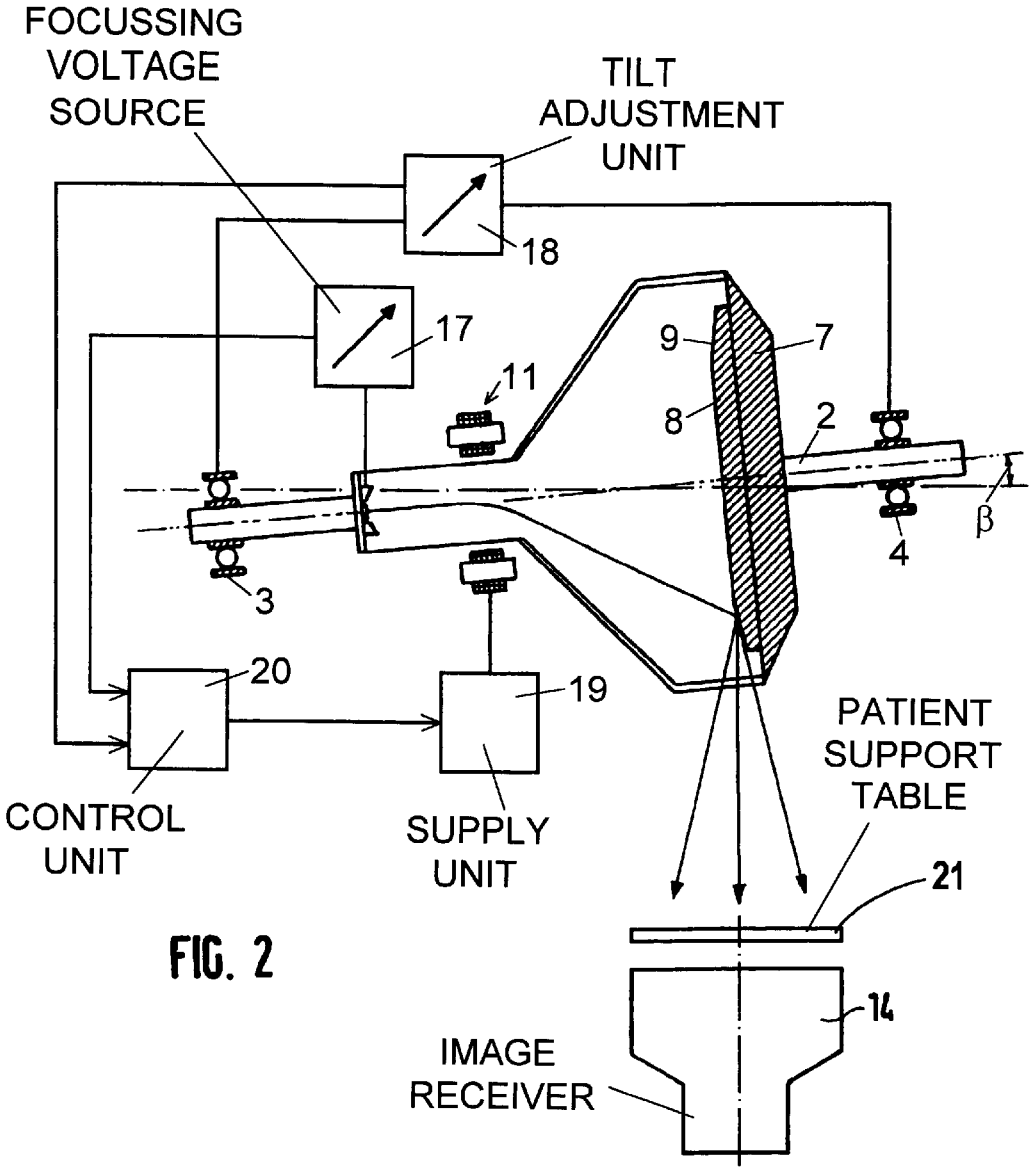
FIG. 2 is a view corresponding to FIG. 1 with the x-ray tube tilted in the position shown in FIG. 1.

FIGS. 1 and 2 schematically show an inventive x-ray apparatus with a rotating bulb tube with vario-focus and electromagnetic electron beam deflection and focusing. A cathode 5 and a focusing electrode 6 rigidly connected to the housing 1 and located on the rotational axis (shown dot-dashed) of the arrangement are arranged in the vacuum-tight housing 1 of the rotating bulb tube. The bulb tube is rotationally seated in bearings 3 and 4 by means of shaft 2 and is driven in rotating fashion by a drive arrangement (not shown). An anode 7 that has a anode dish 8 with an obliquely disposed dish edge 9, i. e. a truncated cone shaped boundary zone, and that is likewise rigidly connected to the housing 1, lies opposite the cathode 5. The electron beam 10 is emitted from the cathode 5 and is focused by the focusing electrode 6 (operated by a focusing voltage source 17) and proceeds toward the anode 7 and is incident thereon in a focal spot. The electron beam 10 exhibits a circular cross-section, whereby the cross-sectional area is determined by the focusing electrode 6. The electron beam 10 is laterally deflected by a first (electromagnetic) field generated with an electromagnetic system 11, so that it strikes the dish edge 9, and also is deformed in cross-section upon retention of its cross-sectional area. The first field is a quadrupole field on which a dipole field is superimposed. Further, the cross-sectional area of the electron beam 10, and thus the area encompassed by the focal spot (referred to below as the focal spot size) can also be set by a second (electrical) field. This second field is generated by means of a focusing voltage that is variable and which can be applied to the focusing electrode 6 by means of focusing voltage source 17, this being indicated by an arrow allocated to the focusing voltage source 17. It is thus possible to vary the focal spot size and the shape of the focal spot, i.e. to generate a vario-focus.

FIG. 1 indicates the case wherein the x-rays 13 emerging from an x-ray exit window 12 extending over the entire circumference of the housing 1 irradiate a small image format, so that only a small aperture angle of the x-ray is required toward the image receiver 14 of the x-ray apparatus. The angle known as the heel angle is indicated with $\alpha$, i.e. the angle between the oblique plane of the dish edge 9 and the direction in which a noticeable radiation can emerge from the anode dish 8 at all. If the focal spot on the anode dish 8 is observed proceeding from the image receiver 14, then the cross-section of the beam 10 should be fashioned optimally quadratic or circular for achieving good image quality.

In the described exemplary embodiment, a patient support table 21 is located between the x-ray tube and the image receiver 14.

In order to irradiate a larger image format, the rotating bulb tube can be inventively tilted in the way shown in FIG. 2, so that the dish angle is modified, i.e. the angle that the dish edge 9 of the anode dish 8 assumes relative to the connecting axis between the focal spot and the center of the image receiver 14. As can be particularly seen from FIG. 3, the shape of the focal spot projected on the image receiver varies. Given a tilt by the angle $\beta$, the length L of the focal spot 15 is no longer imaged corresponding to the width B projected into FIG. 3; rather, due to the tilt, this projection becomes correspondingly longer, so that the projection of the focal spot 15 on the image receiver is no longer a square but a rectangle—no variation ensues in the direction offset by 90°.

In order to compensate this, the deformation of the electron beam 10 inventively ensues via the quadrupole part of the electromagnetic field of the electromagnetic system 11—the dipole part serves the purpose of deflecting the electron beam 10. This results in the electron beam 10 being focused from top to bottom in the direction of the image plane and being defocused in the direction perpendicular thereto. This ultimately results in the modified imaging of the focal spot being shortened in the radial direction of the rotating dish 8 and again being projected onto the image receiver 14 as a square.

Since the focusing voltage at the focusing electrode 6 rotationally symmetrically surrounding the cathode 5 is also variable, the size as well as the ratio of length to width of the electronic focal spot can be set within broad ranges. The focal spot parameters can also be subsequently adjusted for compensating fabrication scatter.

In order to be able to tilt the x-ray tube in the described way, a tilt adjustment unit 18 schematically indicated in FIGS. 1 and 2 is provided; this can be constructed without difficulty by a person of ordinary skill in the art, for example, as an electromechanical adjustment unit. A drive circuit 19 is provided for the drive of the electromagnetic system 11. The drive circuit 18 dependent on the fashioning of the electromagnetic system, contains one or more current sources that supply the electromagnetic system 11 with direct current such that the quadrupole field and the dipole field superimposed thereon are generated.

The focusing voltage source 17, the tilt adjustment unit 18 and the supply unit 19 are connected via corresponding lines to a control unit 20 that, taking the focal spot size set with the focusing voltage source 17 into consideration, drives the supply unit 19 such that a focal spot geometry is set which corresponds to the dish angle set with the adjustment unit 18. This causes the focal spot to have a quadratic or circular contour (outline) as seen in the direction of the connecting axis between the focal spot and the center of the image receiver 14.

The invention is not limited to an x-ray apparatus having a rotating bulb 2. A rotating anode tube can also be provided instead of a rotating bulb 2.

Figure 3:
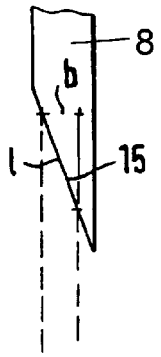
FIG. 3 is a detail of the x-ray tube of the x-ray apparatus according to FIGS. 1 and 2.
Figure 4:
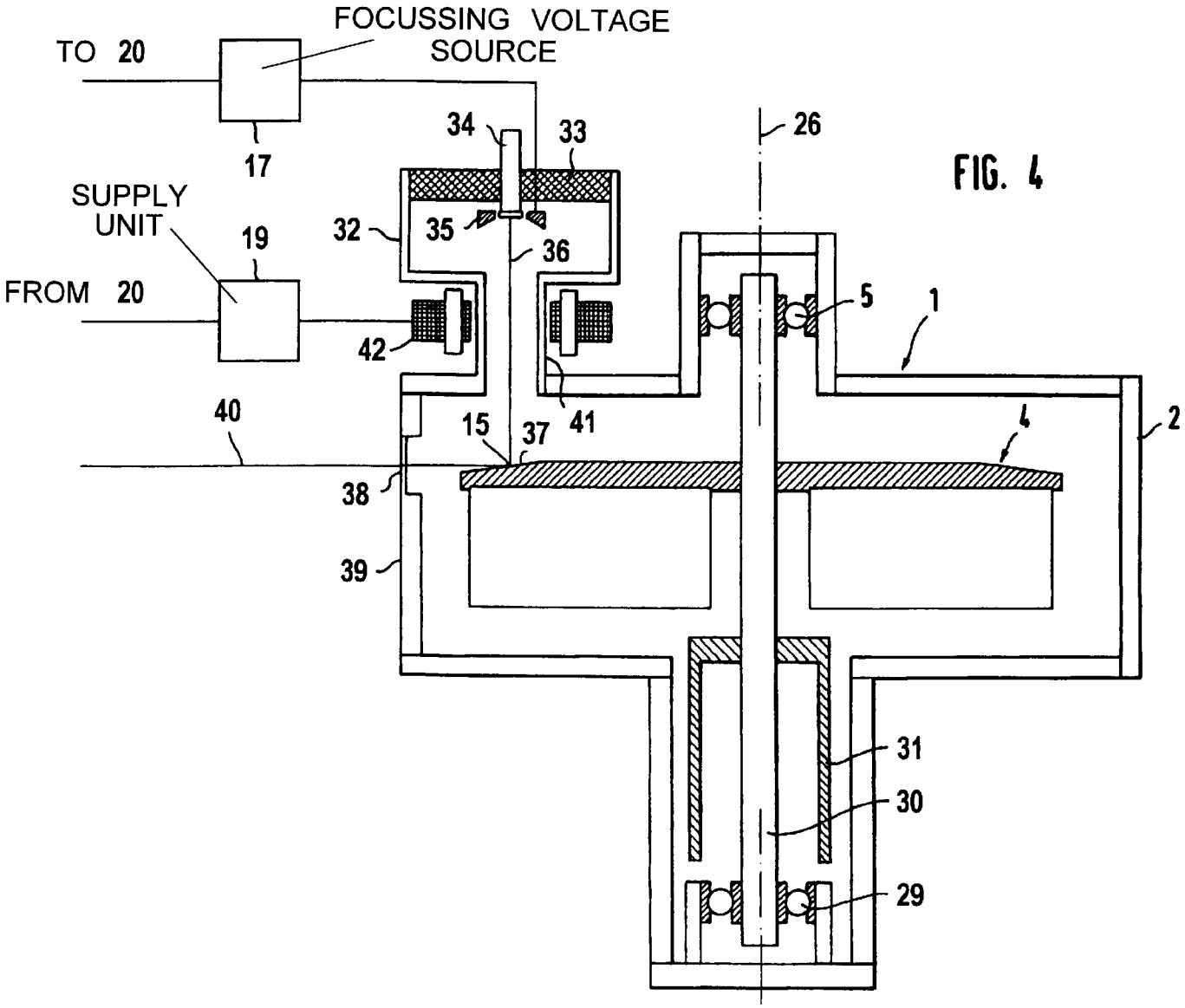
FIG. 4 is a schematic view of a rotating anode x-ray tube that can be utilized instead of the rotating bulb tube in the inventive x-ray apparatus according to FIGS. 1–3.

A rotating anode tube that can be utilized in the x-ray apparatus according to FIGS. 1–3 instead of the rotating bulb tube is shown in FIG. 4 without the adjustment unit 18 and the control unit 20.

FIG. 4 shows a rotating anode x-ray tube 24 having a stationary housing 25 in which the anode dish 27 is seated so as to be rotatable around a rotational axis 26. Ball bearings 28 and 29 for rotationally bearing the shaft 30 of the anode dish 27 and the rotor of the drive system can be seen at 31. A housing shoulder 32, i. e. a cup shaped section of housing 25, that contains the cathode 34 seated in the cathode insulator 33 and its focusing electrode 35 is arranged at the housing 25 offset relative to the rotational axis 26. This electron beam generating system composed of the cathode 34 and the focusing electrode 35 generates a rotationally-symmetrical circular electron beam 36 that, due to the offset of the housing shoulder 32 relative to the rotational axis 26, strikes the oblique dish edge 37 of the rotating anode 27 and generates the x-rays 40 emerging from the exit window 38 of the side wall 39 of the housing 25. The housing shoulder 32 is provided with a constriction around which an electromagnetic system 11 for generating a dipole-free quadrupole field is arranged in order to focus the initially circular electron beam 36 in one direction and in order to defocus it in the other, so that the focal spot of the x-ray tube can be continuously adjusted within broad limits with simple parameters controllable from the outside. A focal spot according to IEC-Standard 336 can be generated for any application by the variation of the focusing voltage (absolute size) and of the quadrupole current (length ratio), as in the case of the above-described rotating bulb tube.

Figure 5:
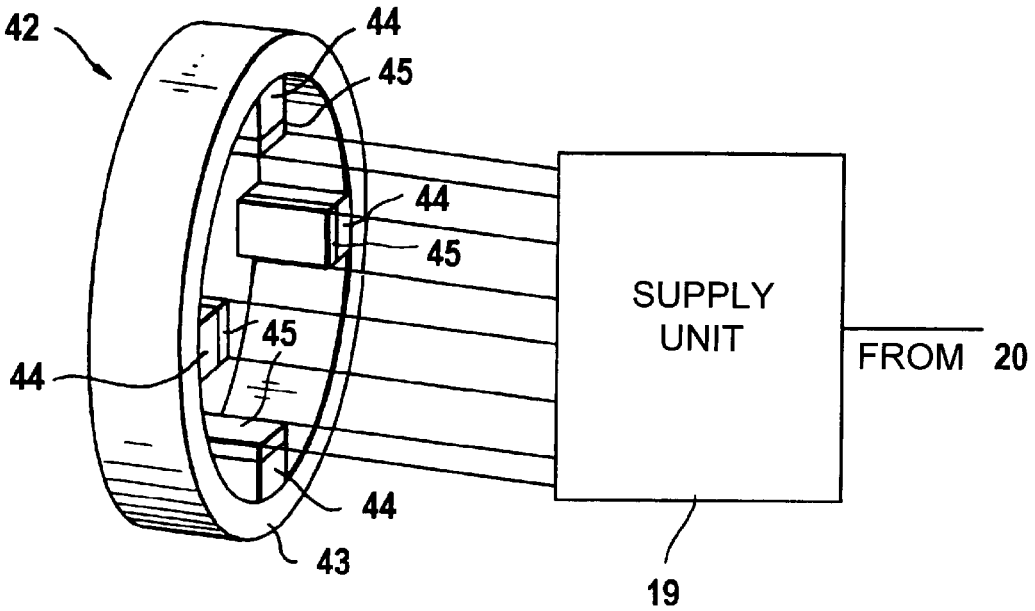
FIG. 5 is a perspective view of the electromagnetic system of the x-ray apparatus according to FIGS. 1–3 or FIG. 4.

The electromagnetic system 11 shown in FIG. 5, which is suitable for the rotating bulb tube as well as for the rotating anode tube, has a carrier 43 in the form of a cylindrically and circularly fashioned iron yoke having four radially projecting pole projections 44 arranged at its interior. These pole projections 44 are spaced uniformly from one another by a respective angle of 90° and exhibit an essentially rectangular cross-section. The spacing of the pole projections 44 lying opposite one another is dimensioned such that it just corresponds to the outside diameter of the cylindrical constriction 41 of the housing shoulder 39, since the carrier 43 is to be arranged around this region. This requires that the carrier 43 be composed of components(in a way not shown) and held together by suitable means (not shown) after application in the constriction 44. Respective coil elements 45 are schematically shown in FIG. 5, provided at the ends of the pole projections 44. The coil elements are connected to the supply unit 19 connected to the control unit 20, this supply unit 19 being driven by the control unit 20 dependent on the set focal spot size and the type of x-ray tube employed such that direct currents flow through the coil elements 45. These direct currents cause the build-up of a quadrupole field with a superimposed dipole field, or of a dipole-free quadrupole field having the required field strength.

Figure 6:
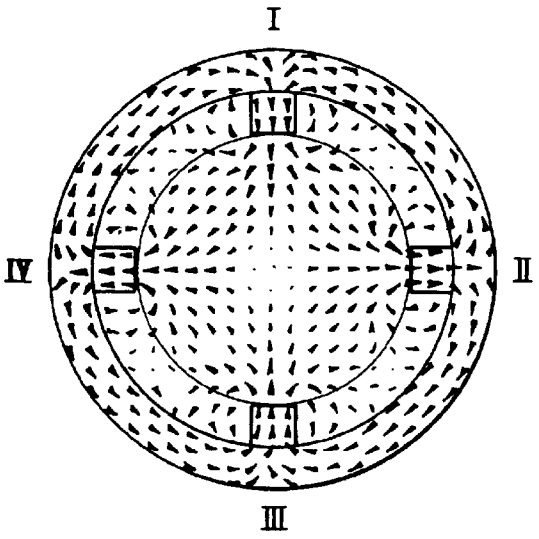
FIG. 6 shows the quadrupole field generated by the electromagnetic system for the x-ray apparatus according to FIG. 4.

The dipole-free quadrupole field required for the rotating anode tube is shown in FIG. 6. The poles I and III therein are north poles and the poles II and IV are south poles. The generated quadrupole field has the property of defocusing the electron beam in one direction, i.e. the electron beam is pulled apart in one direction, and is compressed in the direction perpendicular thereto, so that it is reduced in width. The setting of a line focus is possible in this way. The area of the electron beam does not change, only the ratio of length to width. The focal spot size, however, is adjustable with the focusing electrode 35.

Figure 7:
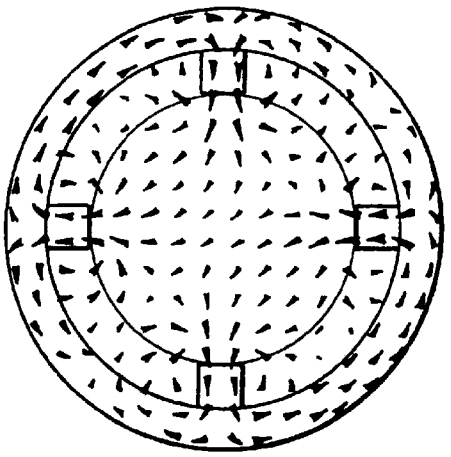
FIG. 7 shows the quadrupole field generated by the electromagnetic system for the x-ray apparatus according to FIGS. 1–3.

The quadrupole field required for the rotating bulb tube with the dipole field additionally superimposed for the deflection of the electron beam is shown in FIG. 7.

Given the inventive x-ray apparatus, the dihedral angle to be irradiated can be arbitrarily set given a freely selectable focal spot. By tilting the rotational axis of the x-ray tube and adaptation of the geometry of the focal spot, a variable dish angle can thus be realized which can be used for a broad spectrum of applications with reference to focal spot size and image formats with a given tube geometry.

Although modifications and changes may be suggested by those skilled in the art, it is the intention of the inventors to embody within the patent warranted hereon all changes and modifications as reasonably and properly come within the scope of their contribution to the art.

We claim as our invention:

1. An x-ray apparatus comprising:

an x-ray tube with vario-focus;

said x-ray tube comprising an evacuated housing having a cathode rigidly mounted therein which emits an electron beam, and an anode dish disposed in said housing on which said electron beam is incident in,a focal spot for causing x-rays to be emitted from said anode dish, and said housing having an x-ray exit window through which said x-rays pass;

an image receiver disposed outside of said evacuated housing onto which said x-rays are incident, said image receiver having a center;

means for tilting said evacuated housing relative to an axis connecting said focal spot and said center of said image receiver so that an axis of said housing forms a tilt angle with said connecting axis; and field generating means disposed for acting on said electron beam for generating a field for varying a cross-sectional shape of said electron beam corresponding to said tilt angle.

2. An x-ray apparatus as claimed in claim 1 wherein said field generating means comprises means for generating a field which changes said cross-sectional shape of said electron beam so that said focal spot, independently of said tilt angle, has a substantially quadratic outline as seen along said connecting axis.

3. An x-ray apparatus as claimed in claim 1 wherein said field generating means comprises means for generating a field which changes said cross-sectional shape of said electron beam so that said focal spot, independently of said tilt angle, has a substantially circular outline as seen along said connecting axis.

4. An x-ray apparatus as claimed in claim 1 wherein said field generated by said field generating means comprises a first field, and wherein said field generating means comprises means for generating a second field, in addition to said first field, for modifying a cross-sectional area of said electron beam and thus also modifying an area of said focal spot.

5. An x-ray apparatus as claimed in claim 4 wherein said field generating means comprises means for generating said first and second fields so that, independently of said tilt angle, an area of an image of said focal spot projected onto said image receiver by parallel projection along said connecting axis and an outline of said focal spot as seen along said connecting axis remain the same.

6. An x-ray apparatus as claimed in claim 5 wherein said field generating means comprises means for varying said second field, independently of said tilt angle, for setting said area of the image of said focal spot projected onto the image receiver by parallel projection along said connecting axis to a selected size.

7. An x-ray apparatus as claimed in claim 1 wherein said field generating means comprises means, for any tilt angle in a range from 0° through 16°, for adjusting dimensions of an image of said focal spot projected onto said image receiver by parallel projection along said connecting axis to conform to IEC-Standard 336.

8. An x-ray apparatus as claimed in claim 1 wherein said field generating means comprises means for generating said field as a quadrupole field.

9. An x-ray apparatus as claimed in claim 1 wherein said housing of said x-ray tube is stationary, and wherein said x-ray tube further comprises means for rotating said anode dish relative to said stationary housing.

10. An x-ray apparatus as claimed in claim 9 wherein said anode dish has a rotational axis, said rotational axis being offset parallel to an axis of said electron beam, and wherein said field generating means comprises means for generating a dipole-free quadrupole field which exclusively deforms the cross-section of said electron beam.

11. An x-ray apparatus as claimed in claim 1 wherein said housing of said x-ray tube is supported in bearings rotatably around an axis of rotation, said anode dish being rigidly connected to said housing, said cathode being arranged on said axis of rotation, and said housing with said bearings, said anode and said cathode being tiltable to said connecting axis, and wherein said field generating means comprises means for generating a quadrupole field with a dipole field superimposed thereon for deflecting said electron beam.

12. An x-ray apparatus as claimed in claim 1 wherein said field generating means comprises an electromagnetic system.

13. An x-ray apparatus as claimed in claim 12 wherein said electromagnetic system comprises a plurality of coil elements disposed on a common carrier and at least partially surrounding said housing.

14. An x-ray apparatus as claimed in claim 13 wherein said electromagnetic system further comprises pole projections on which said coil elements are respectively disposed, said projections being mounted on said carrier and extending from said carrier toward said housing.

* * * * *